United States Patent [19]

Chuan et al.

[11] Patent Number: 4,839,780

[45] Date of Patent: Jun. 13, 1989

[54] SIMULATIVE CANDLE

[75] Inventors: Chuang T. Chuan; Der C. Cheng, both of Hsinchu, Taiwan

[73] Assignee: Ta Yu Electric Co., Ltd., Taiwan

[21] Appl. No.: 220,577

[22] Filed: Jul. 18, 1988

[51] Int. Cl.[4] ..... F21K 2/08

[52] U.S. Cl. ..... 362/265; 362/810; 362/392

[58] Field of Search ..... 362/265, 392, 810, 263

[56] References Cited

U.S. PATENT DOCUMENTS

| | | | |
|---|---|---|---|
| 3,368,107 | 2/1968 | Skirvin | 362/810 |
| 3,500,126 | 3/1970 | Ford | 362/392 |
| 3,873,880 | 3/1975 | Riddell | 315/58 |
| 4,074,165 | 2/1978 | Moriyama | 362/810 |
| 4,159,442 | 6/1979 | Komatsu | 362/810 |
| 4,271,375 | 6/1981 | Hosono | 315/135 |
| 4,510,556 | 4/1985 | Johnson | 362/810 |
| 4,667,132 | 5/1987 | Leale | 315/282 |

*Primary Examiner*—Ira S. Lazarus
*Assistant Examiner*—David G. Messer
*Attorney, Agent, or Firm*—Notaro & Michalos

[57] ABSTRACT

A simulative candle includes a housing receiving therein a battery, an oscillator converting the battery power into an a.c. power, a half-wave-rectifying filtering network changing the a.c. power into an astable high-voltage d.c. electric power, and a neon lamp energized by the astable d.c. power to sparkle like a real candle flame.

4 Claims, 3 Drawing Sheets

SIMULATIVE CANDLE

BACKGROUND OF THE INVENTION

The present invention relates to a decorative lamp, and more particularly to a lamp using a battery.

Nowadays, there are two types, of power supply for Christmas decorative lamps i.e. a.c. and d.c. These, however, have the following disadvantages.

(1) The a.c. powered lamp is limited by the length of the electric wire and requires a power-supplying socket. Such a decorative lamp can not be put at any place at one's option. In addition, since the a.c. power is normally relatively high, a dangerous situation may result when there is an internal short circuit. Thus, it is inconvenient and may be dangerous.

(2) The d.c. powered lamp is battery-powered and uses tungsten wire. It is thus power-consuming and has a shortened life. In addition, since it is battery-powered, its light is monotonous and not dynamically decorative.

SUMMARY OF THE INVENTION

It is therefore an object of the present invention to provide a simulative candle capable of being conveniently used and having a dynamically decorative effect.

It is further an object of the present invention to provide a simulative candle having a lengthened life and being lower in power consumption.

According to the present invention, a simulative candle includes a housing receiving therein a battery, an oscillator converting the battery power into an a.c. power, a half-wave-rectifying filtering d.c. electric power, and a neon lamp energized by the astatic d.c. power to sparkle like a real candle flame.

The present invention may best be understood through the following description with reference to the accompanying drawings, in which:

DETAILED DESCRIPTION OF THE PREFERRED EMBODIMENT

Figure 1:
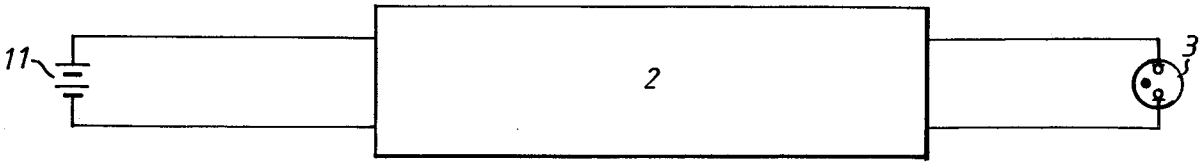
FIG. 1 is a block diagram showing a simulative candle according to the present invention.

Referring now to FIGS. 1–4, the present simulative candle includes a housing (4, 42) for receiving therein a battery 11 providing a d.c. power, a converter 2 which first converts the battery power into an astatic high-voltage but small-current electric power (having a ripple frequency), and a neon lamp 3 energized by the astatic power and having two electrode piece 31, 32. The sparkling characteristic of lamp 3 can be varied and determined by adjusting an oscillating frequency and the astatic power in converter 2 and/or suitably shaping electrode piece 31, 32 in order to simulate a candle flame and/or to be dynamically decorative.

Converter 2 includes an oscillator constituted by a transistor 21 and an inductance coil 22 for converting the battery power into high-voltage but small-current a.c. power having a fixed frequency, and a half-wave-rectifying filtering network formed by a rectifying diode 27 and a filtering capacitor 26 for changing the a.c. power into an astatic d.c. power with a ripple which energizes lamp 3. Since the frequency can be adjusted by varying the inductance of coil 22, the lamp 3 can be stimulated to sparkle like a real candle flame. Since the working principle of these electric elements is well known in the art, any further detail therefor will not be given here.

Figure 2:
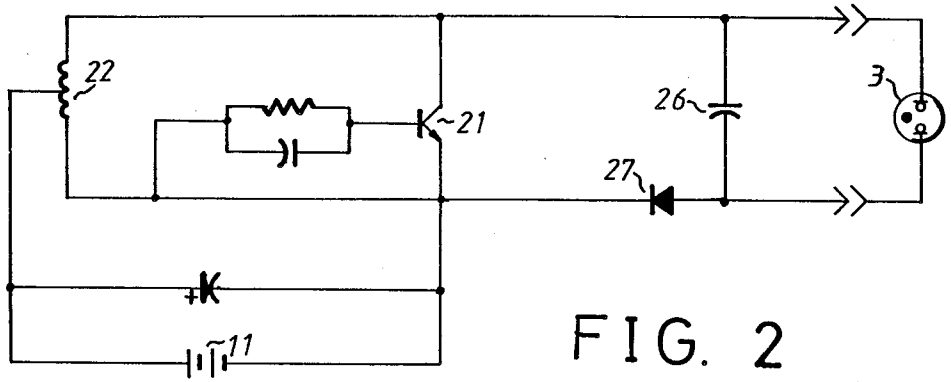
FIG. 2 is a circuit diagram showing a simulative candle in FIG. 1.
Figure 3:
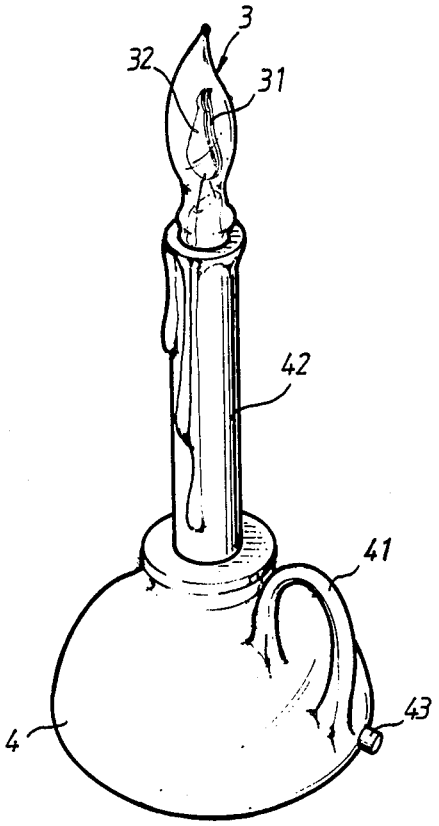
FIG. 3 is a perspective view showing a preferred embodiment of a simulative candle according to the present invention.
Figure 4:
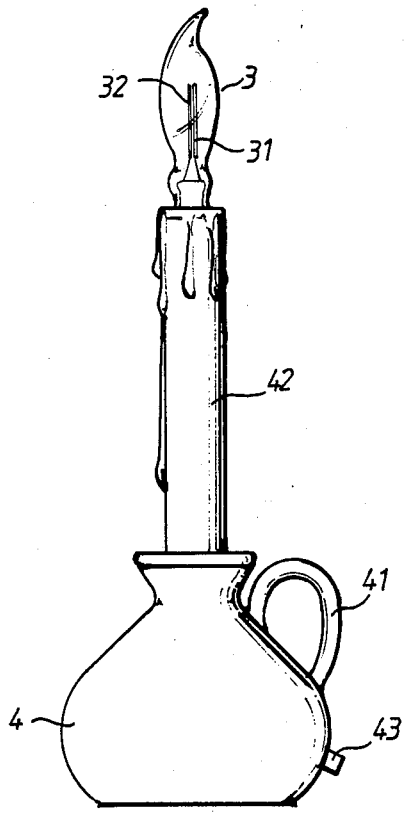
FIG. 4 is a side view of FIG. 3 according to the present invention.

As shown in FIG. 2, the coil 22 has opposite ends connected between the emitter and collector of transistor 21. A parallel RC circuit is connected between the base of transistor 21 and one of the opposite ends of coil 22. Battery 11 is connected between a tap of coil 22 and the one end of the coil 22 which is connected to the RC circuit. A further capacitor is connected in parallel to battery 11. The diode 27 of the filtering network is connected between the one end of the coil 22 and one electrode of lamp 3. The opposite electrode of lamp 3 is connected to the opposite end of coil 22. Capacitor 26 of the filtering network is connected between the electrodes of the lamp.

The housing can include a candle holder 4 having a handle 41 and a switch 43 for controlling whether battery 11 is providing its d.c. power for converter 2. A candle body portion 42 is mounted on candle holder 4 and carries thereon the neon lamp 3 having, electrode pieces which dynamically sparkle like a real candle flame.

Through the above description, it should now become readily apparent how and why the present invention can achieve the objects it contemplates.

What I claim is:

1. A simulative candle comprising:

a housing;

a battery receiving in said housing for providing a first d.c. electric power;

an oscillator electrically connected to said battery for converting said d.c. power into an a.c. electric power;

a half-wave-rectifying filtering network electrically connected to said a.c. power into an astatic high-voltage d.c. electric power;

a neon lamp electrically connected to said filtering network for being energized by said astatic high-voltage d.c. power;

said oscillator comprising a coil having a first end, and opposite second end and an intermediate tap connection, a transistor having an emitter and collector connected between said first and second ends of said coil, a parallel RC circuit connected between the base of said transistor and the first end of said coil, said battery being connected between said tap and said first end of said coil; and said lamp having a pair of electrodes, said filtering network comprising a diode connected between one of said electrodes and the first end of said coil with a capacitor connected between said electrodes of said lamp.

2. A simulative candle according to claim 1 including a further capacitor connected in parallel across said battery.

3. A simulative candle according to claim 2 wherein said diode has a first end connected to the first end of said coil and at opposite second end connected to one end of the capacitor of said filtering network and one electrode of said lamp.

4. A simulative candle according to claim 3 wherein the emitter of said transistor is connected to the first end of said coil and the collector of said transistor is connected to the opposite second end of said coil.

* * * * *